US010183773B2

(12) United States Patent
Zierden et al.

(10) Patent No.: US 10,183,773 B2
(45) Date of Patent: Jan. 22, 2019

(54) EASY THREAD CARRIAGE FOR STRETCH FILM WRAPPING SYSTEM

(71) Applicants: Dana L. Zierden, Eagle Bend, MN (US); Mallory K. Sagedahl, Alexandria, MN (US)

(72) Inventors: Dana L. Zierden, Eagle Bend, MN (US); Mallory K. Sagedahl, Alexandria, MN (US)

(73) Assignee: BRENTON LLC, Alexandria, MN (US)

( * ) Notice: Subject to any disclaimer, the term of this patent is extended or adjusted under 35 U.S.C. 154(b) by 466 days.

(21) Appl. No.: 14/928,044

(22) Filed: Oct. 30, 2015

(65) Prior Publication Data

US 2016/0122053 A1 May 5, 2016

Related U.S. Application Data

(60) Provisional application No. 62/073,575, filed on Oct. 31, 2014.

(51) Int. Cl.

| | |
|---|---|
| ***B65B 41/16*** | (2006.01) |
| ***B65B 11/02*** | (2006.01) |
| ***B65B 11/04*** | (2006.01) |
| ***B65B 45/00*** | (2006.01) |

(52) U.S. Cl.

CPC ..... *B65B 41/16* (2013.01); *B65B 11/025* (2013.01); *B65B 11/045* (2013.01); *B65B 45/00* (2013.01); *B65B 2210/20* (2013.01)

(58) Field of Classification Search

CPC ..... B65B 11/045
USPC ..... 53/556–557
See application file for complete search history.

(56) References Cited

U.S. PATENT DOCUMENTS

| | | | |
|---|---|---|---|
| 4,222,913 | A | 9/1980 | Cooper |
| 4,509,432 | A | 4/1985 | Win |
| 4,514,955 | A | 5/1985 | Mouser et al. |
| 4,573,305 | A | 3/1986 | Wildmoser |
| 4,628,668 | A | 12/1986 | Wildmoser |
| 4,833,017 | A | 5/1989 | Benoit |
| 4,846,077 | A | 7/1989 | Win |
| 4,963,388 | A | 10/1990 | Benoit |
| 5,035,323 | A | 7/1991 | Daniels et al. |
| 5,093,188 | A | 1/1992 | Dohrer |
| 5,140,795 | A | 8/1992 | Steding |
| 5,208,096 | A | 5/1993 | Dohrer |

(Continued)

FOREIGN PATENT DOCUMENTS

WO WO 2009/089279 A1 7/2009

*Primary Examiner* — Lori Baker
(74) *Attorney, Agent, or Firm* — Thompson Hine LLP

(57) ABSTRACT

A stretch film wrapping machine includes a wrap location and a film carriage that is movable during wrap operations. The film carriage includes a first driven roller, a second driven roller and a drive a drive arrangement for the driven rollers. The carriage includes a primary frame part and a secondary frame part. A film path runs between the primary frame part and the secondary frame part and passes between the driven rollers. The secondary frame part moves relative to the primary frame part between an open position for film threading and a closed position for operation. The second driven roller is mounted to the secondary frame part for movement therewith and has a driven gear that engages with a drive gear of the drive arrangement when the secondary frame part is in the closed position. In the open position the driven gear dis-engages from the drive gear.

13 Claims, 11 Drawing Sheets

(56) References Cited

U.S. PATENT DOCUMENTS

| | | | |
|---|---|---|---|
| 5,531,327 | A | 7/1996 | Darby |
| 5,569,693 | A | 10/1996 | Doshi et al. |
| 5,606,849 | A | 3/1997 | Bettenhausen |
| 5,660,025 | A | 8/1997 | Timen |
| 5,660,084 | A | 8/1997 | Bettenhausen |
| 5,730,295 | A | 3/1998 | Darby |
| 6,370,839 | B1 | 4/2002 | Nakagawa et al. |
| 6,439,383 | B1 | 8/2002 | Janousek |
| 6,564,532 | B2 | 5/2003 | Gutche |
| 6,713,010 | B1 | 3/2004 | Doran et al. |
| 7,269,935 | B2 | 9/2007 | Jafari |
| 7,845,054 | B2 | 12/2010 | Schmitz et al. |
| 8,001,745 | B2 | 8/2011 | Carter et al. |
| 8,074,431 | B1 | 12/2011 | Pierson et al. |
| 8,220,229 | B1 | 7/2012 | Pierson et al. |
| 8,276,346 | B2 | 10/2012 | Lancaster, III et al. |
| 8,453,420 | B2 | 6/2013 | Schmidt et al. |
| 8,539,739 | B2 | 9/2013 | Pierson et al. |
| 8,939,939 | B2 | 1/2015 | Funamura et al. |
| 2002/0055803 | A1 | 5/2002 | Stork et al. |
| 2009/0178374 | A1 | 7/2009 | Lancaster, III et al. |

EASY THREAD CARRIAGE FOR STRETCH FILM WRAPPING SYSTEM

CROSS-REFERENCES

This application claims the benefit of U.S. Provisional Application Ser. No. 62/073,575, filed Oct. 31, 2014, which is incorporated herein by reference.

TECHNICAL FIELD

The present application relates to a system for applying stretch wrap film to loads, such as palletized loads, and more particularly to a film support and feed carriage stretch wrap film applying machines.

BACKGROUND

Palletized loads are typically wrapped in plastic stretch film prior to shipping to stabilize the load on the pallet and prevent product shifting off of the pallet during transport. By way of example, automated systems are known in which the palletized load is placed on a load platform that sits alongside a stretch film roll support mechanism (e.g., a support spindle) associated with a movable carriage. To wrap the palletized load the platform and palletized load are rotated causing film to be drawn off of the film roll while the stretch film roll support mechanism is also moved vertically up and down along a mast to cover the full vertical height of the palletized load. In another machine type, the palletized load remains stationary while the film roll support mechanism (e.g., mounted on a mast that extends downward from a rotatable overhead arm) travels around the load to cause film to be drawn off the film roll, while the film roll support mechanism simultaneously moves vertically up and down along the mast.

Such automated machines are commonly used to wrap large numbers of loads over time, and therefore film roll replacement is a task that operators regularly handle. Film roll replacement typically involves removing an empty roll core from the support spindle, loading an new stretch film roll onto the spindle and then threading the leading end of the film of the new film roll through a film stretch and/or feed roller system of the carriage.

Accordingly, it would be desirable to provide a carriage that facilitates the film threading operation.

SUMMARY

In one aspect, a stretch film wrapping machine for wrapping film about palletized loads includes a wrap location for receiving palletized loads to be wrapped and a film carriage that is movable relative to the wrap location during wrap operations. The film carriage includes a film roll support mandrel, and a roller assembly including at least a first driven roller and a second driven roller over which film can pass for delivery to the wrap location. A drive arrangement for the first driven roller and the primary driven roller is located at an upper part of the carriage. The carriage includes a primary frame part and a secondary frame part, where a film path is defined between the primary frame part and the secondary frame part and passes between the first driven roller and the second driven roller. The secondary frame part is movable relative to the primary frame part between an open position to provide access to the film path for the purpose of threading film along the film path and a closed position for operation. The first driven roller is mounted to the primary frame part and the second driven roller is mounted to the secondary frame part for movement therewith. The drive arrangement includes a drive gear on the primary frame part that engages with a driven gear at an end of the second driven roller when the secondary frame part is in the closed position. When the secondary frame part is moved to the open position the driven gear of the second driven roller dis-engages from the drive gear and moves into a spaced apart condition relative to the drive gear.

In one implementation, the drive arrangement is configured to rotate the first driven roller and the second driven roller in opposite directions.

In one implementation, the first driven roller has an upright orientation, the second driven roller has an upright orientation and the secondary frame part is mounted to pivot away from the primary frame part.

In one implementation, the first driven roller has a substantially vertical orientation, the second driven roller has a substantially vertical orientation and the secondary frame part is mounted to pivot away from the primary frame part about a substantially horizontal pivot axis located toward a lower end of the carriage, the driven gear is located at an upper end of the second driven roller.

In one implementation, a housing covers the drive arrangement, the housing includes a downwardly extending housing portion having a upwardly extending slot formed therein, the slot aligned with the drive gear, wherein the driven gear of the second driven roller moves through the slot when the secondary frame part is moved between open and closed positions.

In one implementation, a gear cover is located at one side of the driven gear, the gear cover also moves through the slot when the secondary frame part is moved between open and closed positions, and when the secondary frame part is in the closed position the gear cover and the downwardly extending housing portion cooperate to limit access to the driven gear from external of the carriage.

In one implementation, the carriage is mounted for vertical movement along a mast during wrap operations.

In one implementation, the mast is either (i) movable about the wrap location during wrap operations or (ii) stationary and a load platform of the wrap location is rotated during wrap operations.

In one implementation, a control arrangement, including a control unit and at least one sensor, monitors whether the secondary frame part is in the open or closed position.

In another aspect, a stretch film wrapping machine for wrapping film about loads includes a wrap location for receiving loads to be wrapped and a film carriage that is movable during wrap operations. The film carriage includes a first driven roller, a second driven roller and a drive a drive arrangement for the first driven roller and the second driven roller. The carriage includes a primary frame part and a secondary frame part, where a film path is defined between the primary frame part and the secondary frame part and passes between the first driven roller and the second driven roller. The secondary frame part is movable relative to the primary frame part between an open position to provide access to the film path for the purpose of threading film along the film path and a closed position for operation. The second driven roller is mounted to the secondary frame part for movement therewith and has a driven gear that engages with a drive gear of the drive arrangement when the secondary frame part is in the closed position. When the secondary frame part is moved to the open position the driven gear of the second driven roller dis-engages from the drive gear.

In one implementation, the drive arrangement is configured to rotate the first driven roller and the second driven roller in opposite directions and is located at an upper end of the carriage.

In one implementation, the first driven roller has an upright orientation, the second driven roller has an upright orientation and the secondary frame part is mounted to pivot away from the primary frame part.

In one implementation, the first driven roller has a substantially vertical orientation, the second driven roller has a substantially vertical orientation and the secondary frame part is mounted to pivot away from the primary frame part about a substantially horizontal pivot axis located toward a lower end of the carriage.

In one implementation, a housing covers the drive arrangement, the housing includes a downwardly extending housing portion having a upwardly extending slot formed therein, the slot aligned with the part of the drive arrangement, wherein the driven gear of the second driven roller moves through the slot when the secondary frame part is moved between open and closed positions.

In one implementation, a gear cover is located toward an external side of the driven gear, the gear cover also moves through the slot when the secondary frame part is moved between open and closed positions, and when the secondary frame part is in the closed position the gear cover and the downwardly extending housing portion cooperate to limit access to the driven gear from external of the carriage.

In one implementation, the carriage is mounted for vertical movement along a mast during wrap operations.

In one implementation, the mast is either (i) movable about the wrap location during wrap operations or (ii) stationary and a load platform of the wrap location is rotated during wrap operations.

The details of one or more embodiments are set forth in the accompanying drawings and the description below. Other features, objects, and advantages will be apparent from the description and drawings, and from the claims.

DETAILED DESCRIPTION

Figure 1:
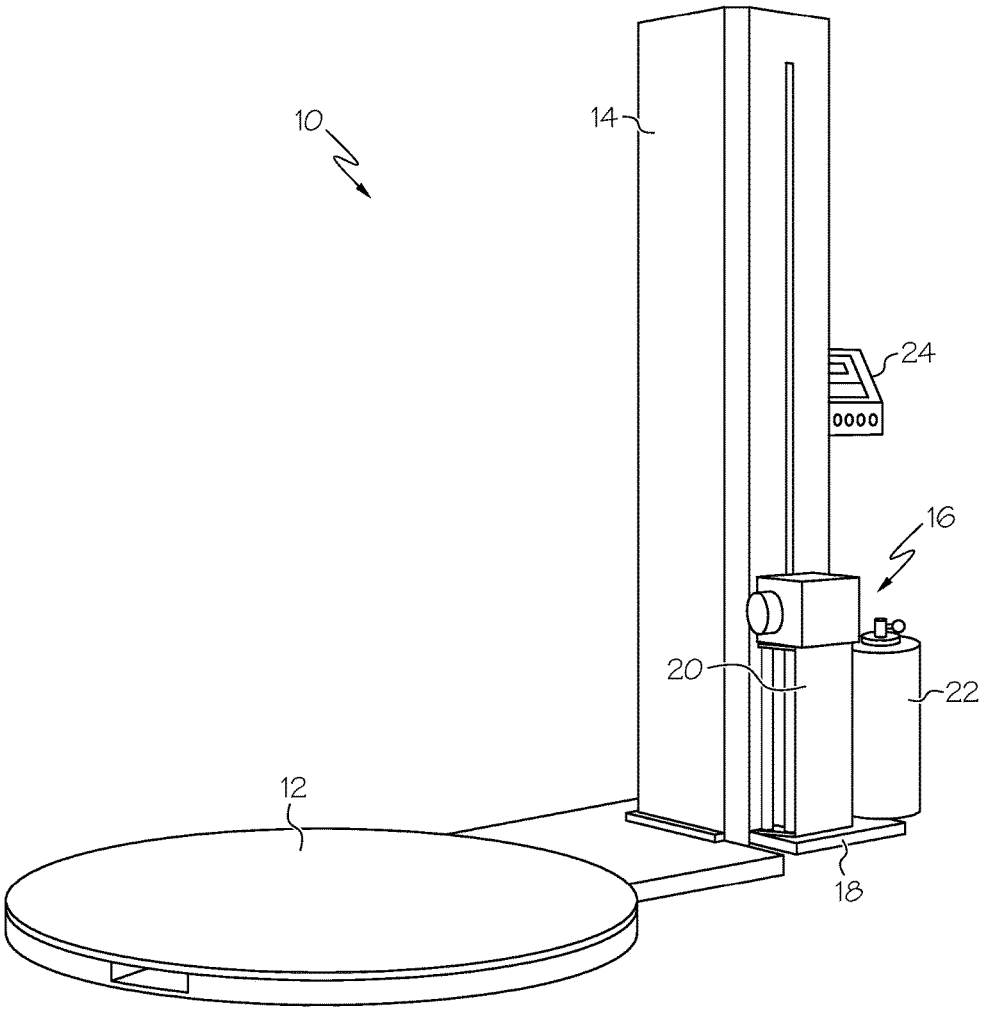
FIG. 1 is a perspective view of one embodiment of a film wrapping machine.

Referring to FIG. 1, one embodiment of a stretch film wrapping system 10 is shown, which includes a rotatable load platform 12 alongside a mast 14 having an associated film dispensing carriage 16 mounted to the mast 14 and movable up and down along the mast 14 for wrap operations. The film dispensing carriage 16 includes a pre-stretch roller assembly 20 that receives film from a film roll 22 mounted on a film roll support mandrel assembly. For wrap operations, a palletized load is placed on the load platform 12 and a free end of the film exiting the pre-stretch roller assembly 20 is attached to the palletized load. The load platform 12 is rotated, thereby rotating the palletized load, and causing film to be drawn from the film dispensing carriage 16. At the same time, the film dispensing carriage 16 is moved vertically up and down along the mast 14 to cover the full vertical height of the palletized load. Variations of such machines include fully automatic systems, in which the machine cuts the film at the end of the rotating operation and presses the trailing end of the cut film against the wrapped load, and semi-automatic systems, in which an operator performs the film cut and pressing steps upon completion of the rotation operation. The system 10 includes an operator interface 24 (aka human machine interface, HMI) with associated controller.

Figure 2:
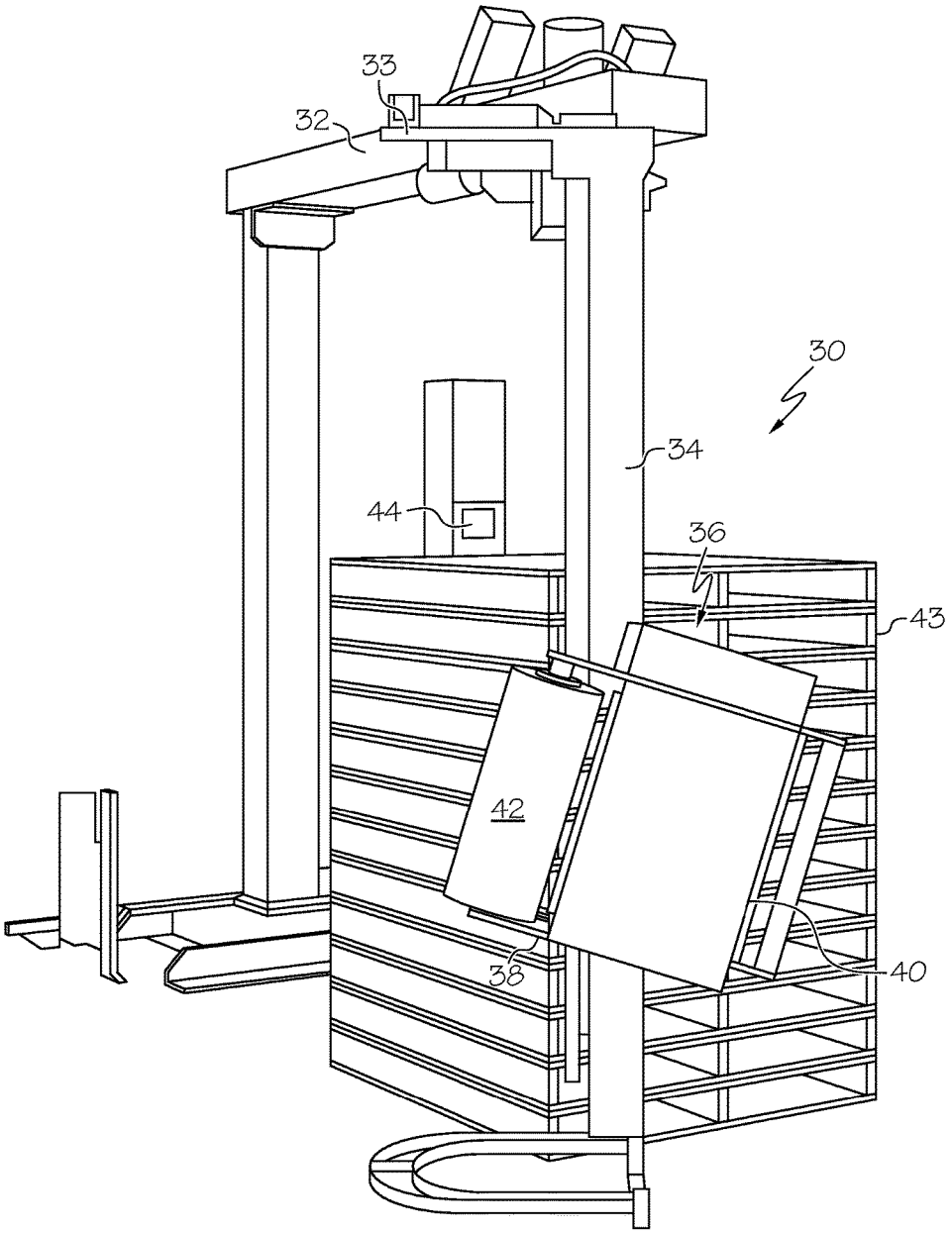
FIG. 2 is a perspective view of another embodiment of a film wrapping machine.

As shown in FIG. 2, another embodiment of a stretch film wrapping system 30 includes an overhead gantry 32 with a rotatable arm 33. A mast 34 extends downward from the end of the arm 33 and includes an associated film dispensing carriage 36 mounted to the mast 34 and movable up and down along the mast 34 for wrap operations. The film dispensing carriage 36 includes a pre-stretch roller assembly 40 that receives film from a film roll 42 mounted on a film roll support mandrel assembly. For wrap operations, a palletized load 43 is positioned under the gantry 32 and centered below the rotation axis of the overhead arm 33. A free end of the film exiting the pre-stretch roller assembly 40 is attached to the palletized load 43. Through rotation of the overhead arm 33, the mast 34 is then rotated about the palletized load 43 while the palletized load 43 remains stationary, causing the film to be drawn from the film dispensing carriage 36. At the same time, the film dispensing carriage 36 is moved vertically up and down along the mast 34 to cover the full vertical height of the palletized load 43. Similar to the machine of FIG. 1, variations of such overhead gantry type machines can include fully automatic systems and semi-automatic systems. The system 30 includes an operator interface 44 with associated controller to control the wrap operation.

Advantageously, the film dispensing system of either of the above machine types, as well as other existing stretch film wrapper machines, can incorporate a film thread feature that provides for simple film threading while at the same time providing an S-path through driven rollers of the pre-stretch roller assembly. One embodiment of this feature is described below with respect to FIGS. 3-13, but other embodiments are contemplated.

Figure 3:
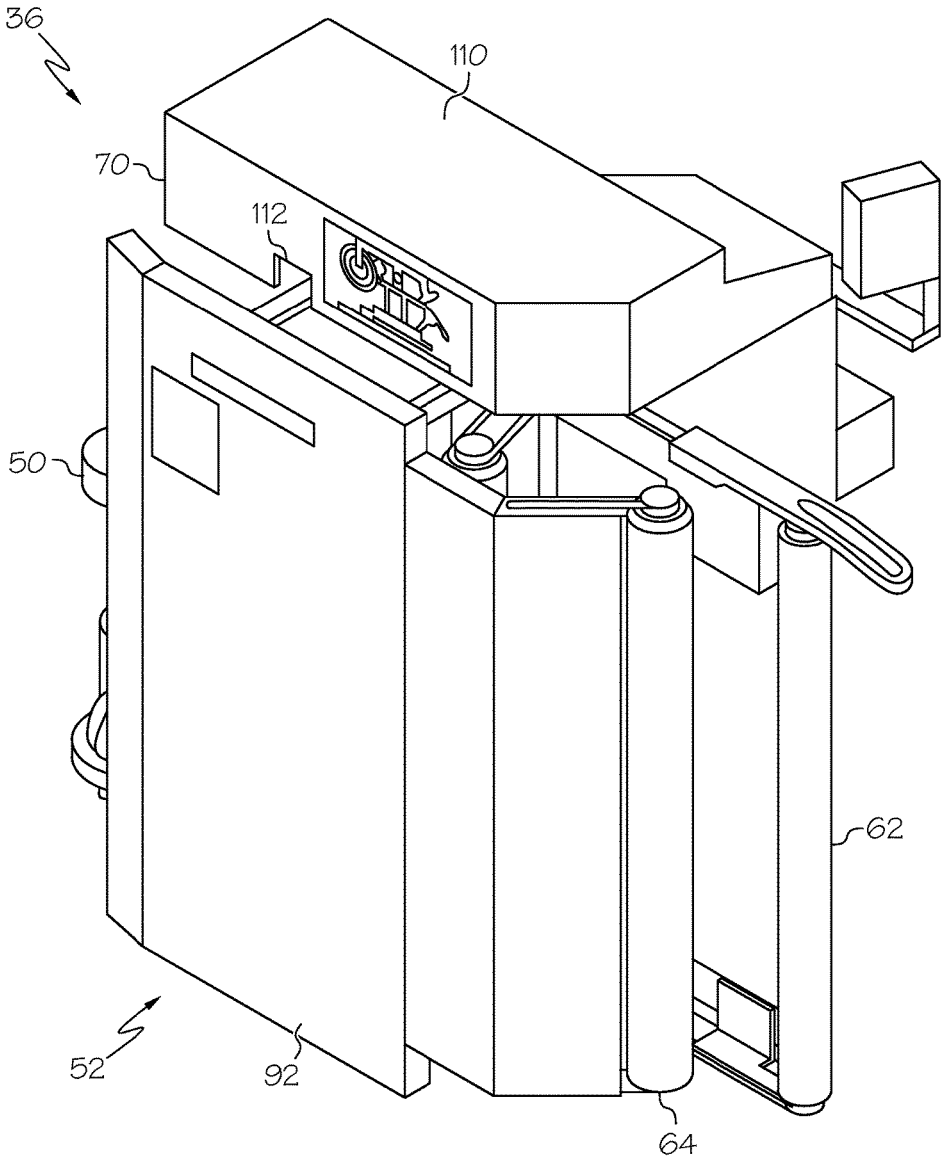
FIGS. 3, 4 and 5 are perspective, top plan and front elevation views respectively of one carriage embodiment.
Figure 4:
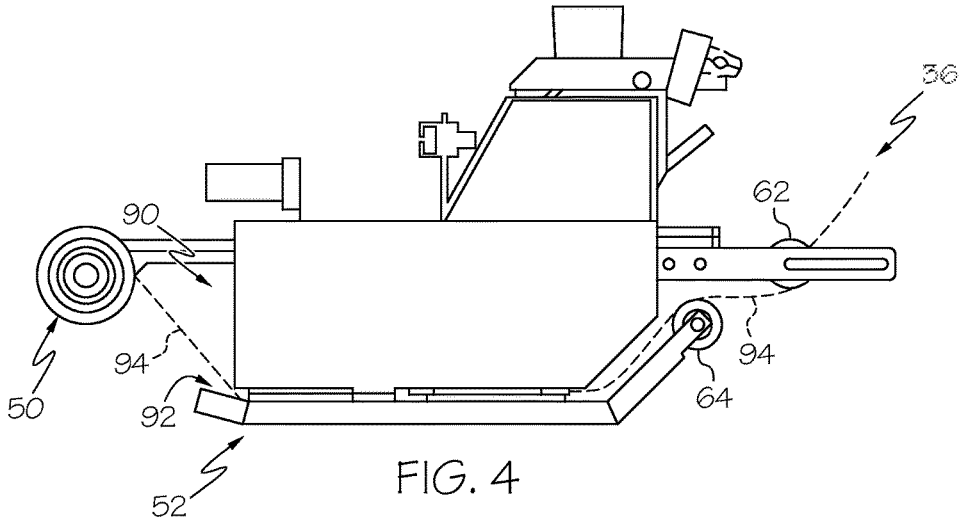
Figure 5:
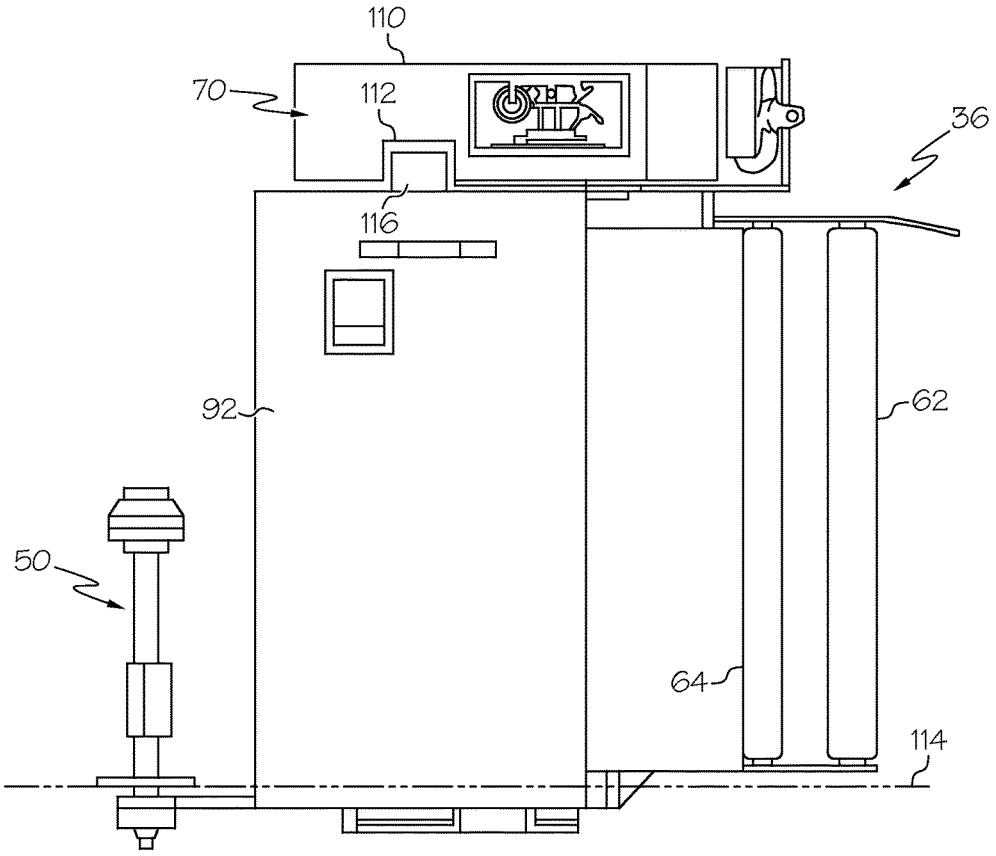
Figure 6:
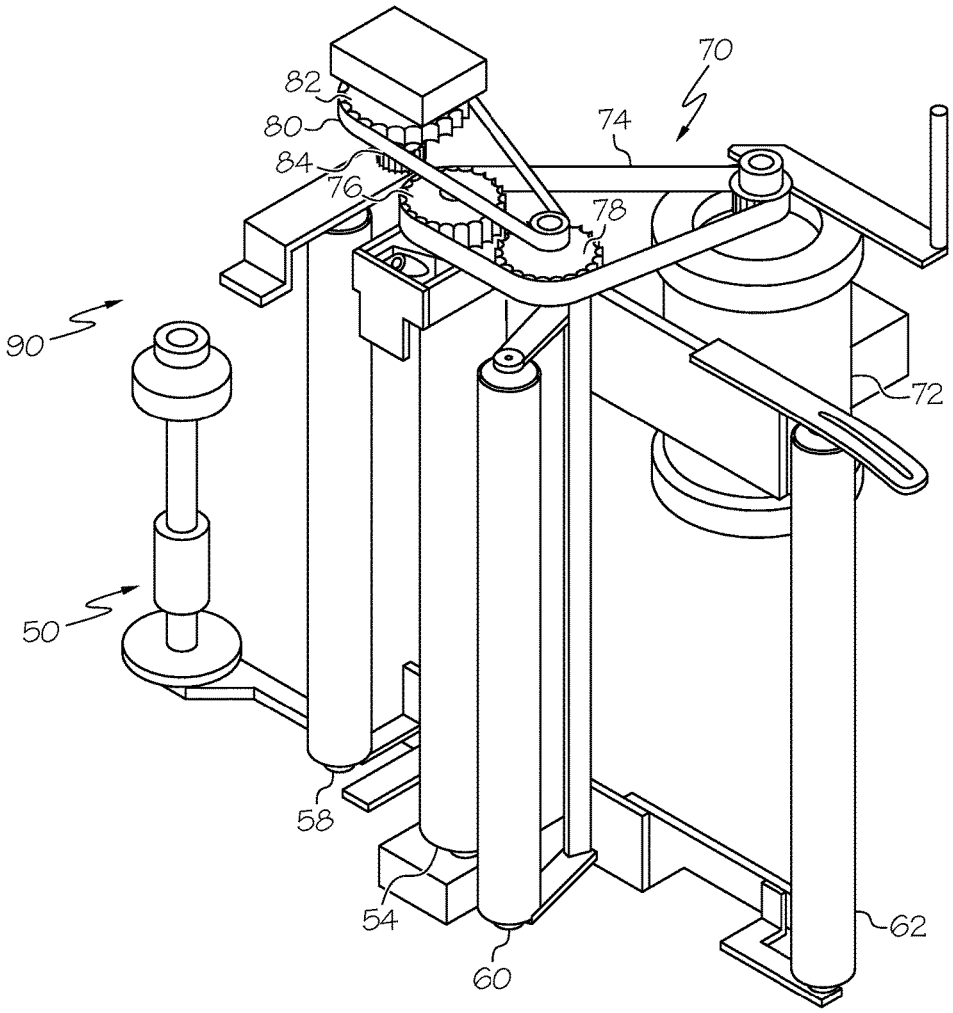
FIG. 6 is a partial perspective view of a part of the carriage.
Figure 7:
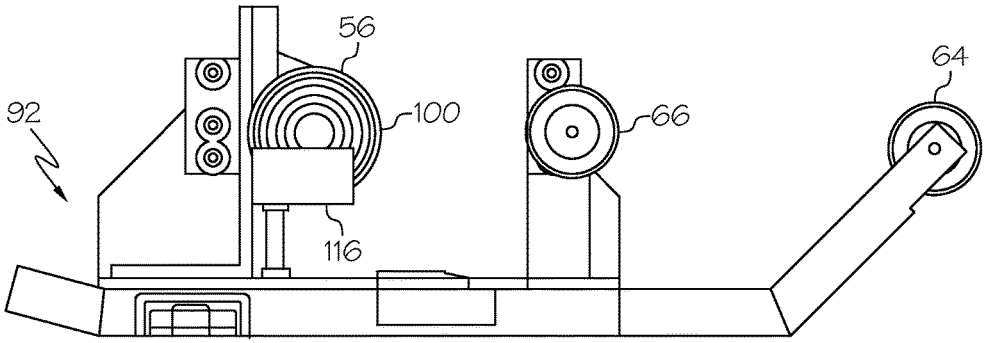
FIG. 7 is a partial top plan view of another part of the carriage.
Figure 8:
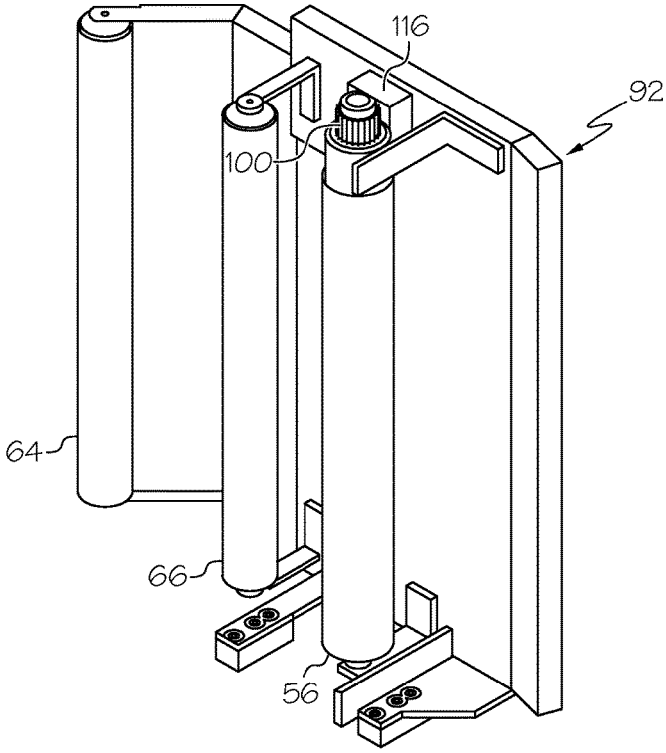
FIG. 8 is a perspective view of the part of FIG. 7.

Referring to FIGS. 3-5, a film dispensing carriage 36 is shown and includes a film roll support mandrel 50 located to one side of a carriage housing 52 within which a set of rollers (not shown) are located. The set of rollers includes at least two driven rollers 54 and 56 (seen in FIGS. 6-8). A film roll is loaded onto the mandrel 50 and fed through the housing 52 and over the driven rollers for delivery to the wrap location of the machine on which the carriage 36 is installed. As shown, in addition to the driven rollers, the carriage 36 may include additional rollers 58, 60, 62, 64 and 66 over which the film may travel as it passes along the film path defined by the carriage 36. A drive arrangement 70 for the driven rollers is located at an upper part of the carriage housing 52, and may include a primary mover, such as motor 72, that drives a belt or chain 74, which in turn engages a driven gear 76 at the top of the driven roller 54. The belt or chain 74 also drives a drive wheel/plate 78 which in turn drives a belt or chain 80 that engages a drive wheel/plate 82, where a drive gear 84 extends downward from drive wheel 82.

The carriage 36 includes a primary frame part 90 (FIG. 6) and a secondary frame part 92 (FIGS. 7 and 8), where the film path 94 is defined between the two frame parts. Within the housing 52 the film path 94 passes between the driven rollers 54 and 56. The secondary frame part 92 is movable relative to the primary frame part 90 between an open position to provide access to the film path 94 for the purpose of threading film along the film path 94 and a closed position for operation. The driven roller 54 and rollers 58, 60 and 62 are mounted to the primary frame part 90, while the driven roller 56 and rollers 64 and 66 are mounted to the secondary frame part 92 so that the rollers 56, 64 and 66 all move with the secondary frame part 92.

Figure 9:
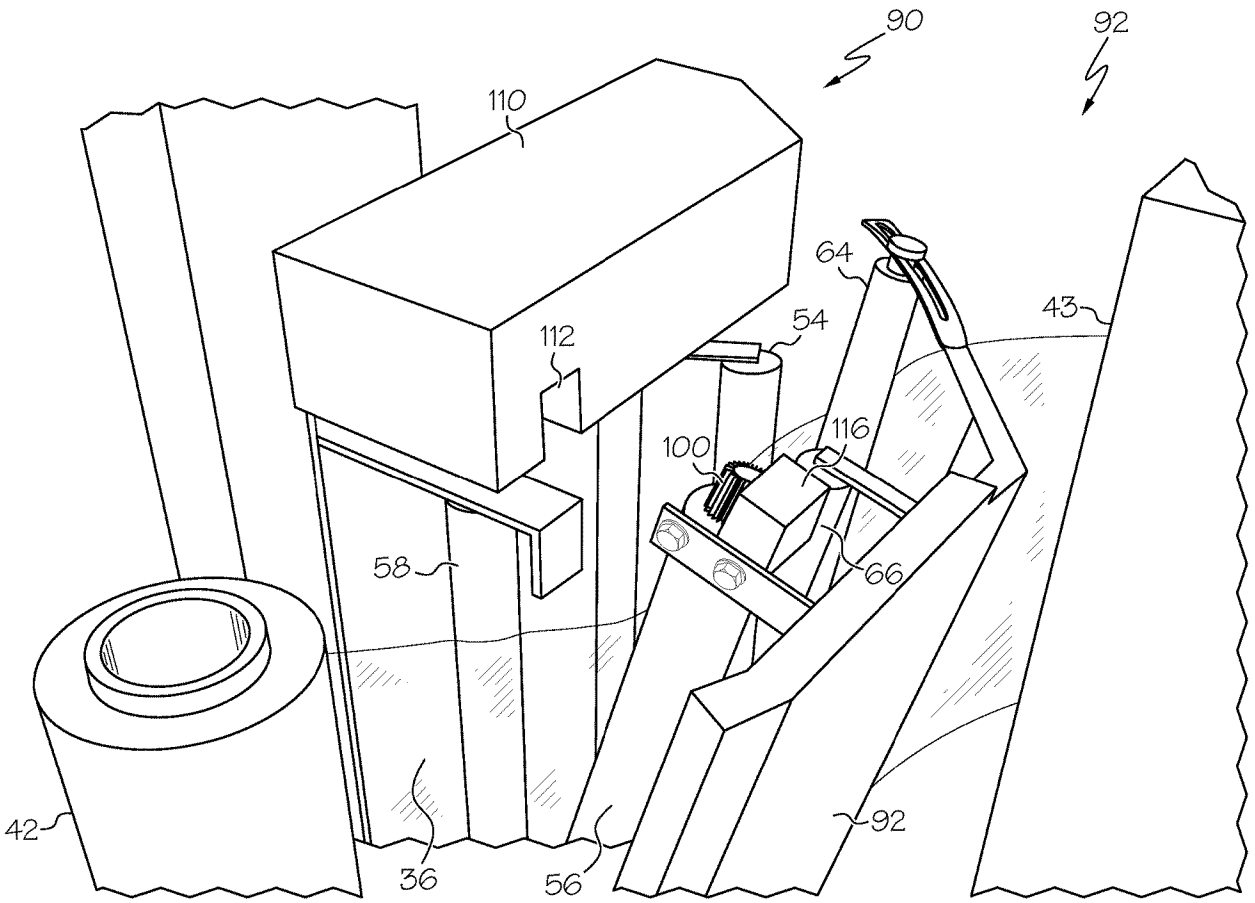
FIG. 9 is a partial perspective view of a carriage in an open condition for film threading.
Figure 10:
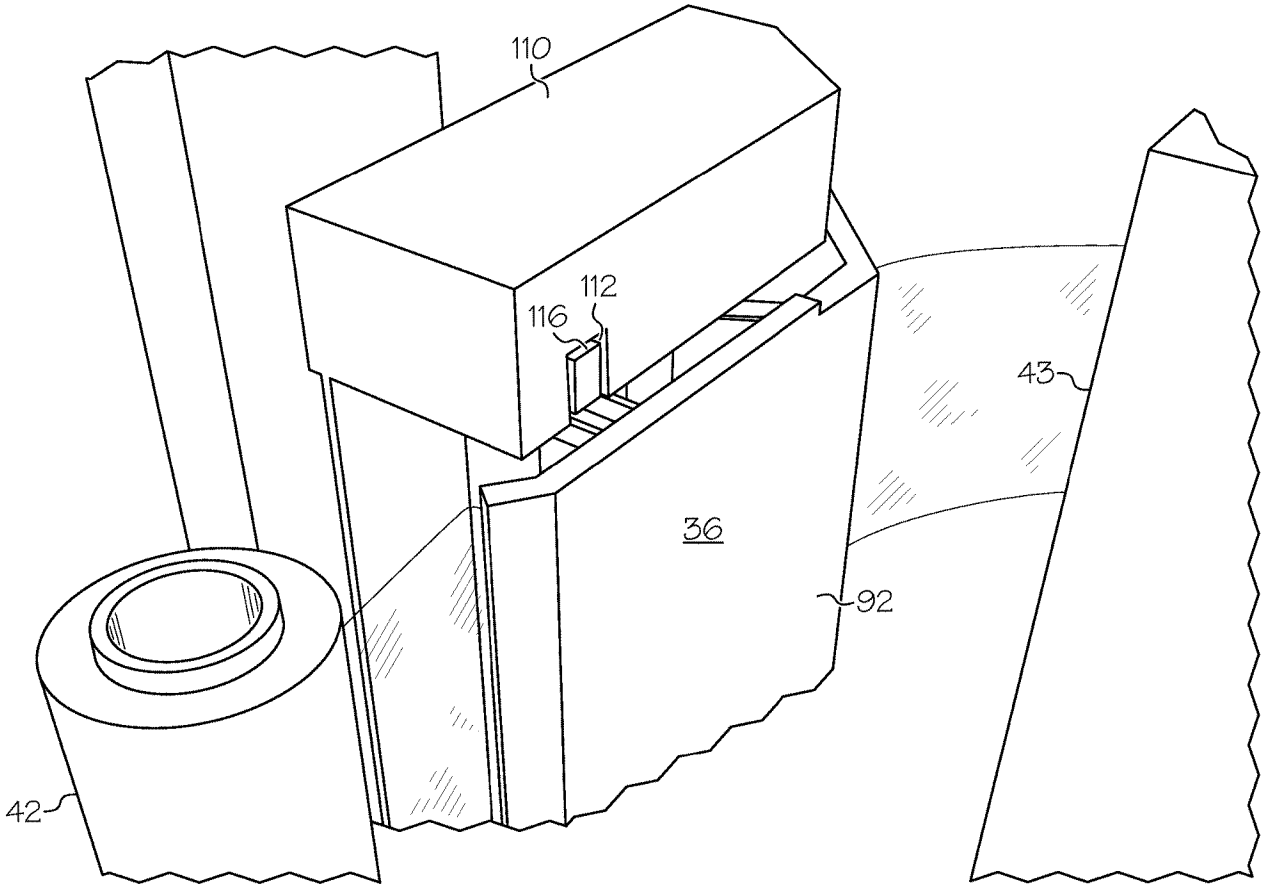
FIG. 10 is a partial perspective view of the carriage in a closed condition.
Figure 11:
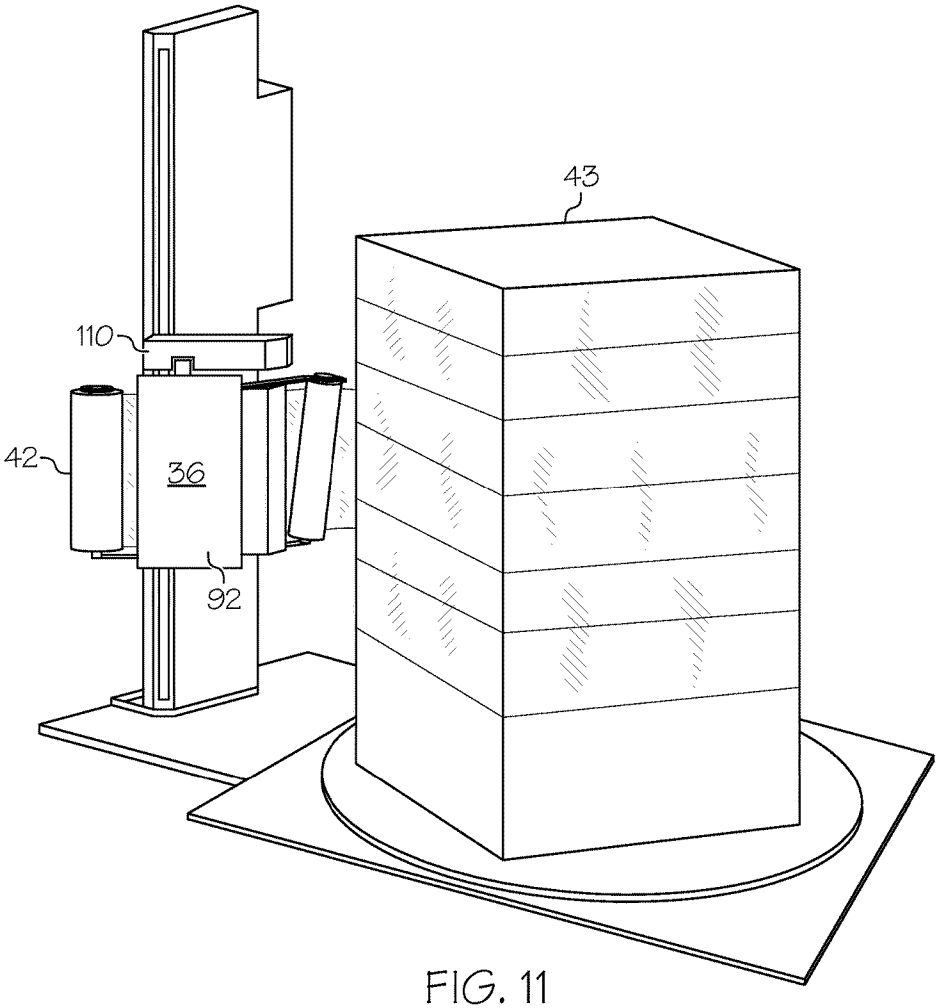
FIGS. 11 and 12 show views of the carriage during a palletized load wrap operation.

In operation, a film roll 42 is mounted on the mandrel 50 and the secondary frame part 92 is moved away from the primary frame part 90 to open the film path 94 as shown in FIG. 9. The film is then pulled through the film path 94 along the externally facing side of all of the rollers 58, 54, 60 and 62. When the secondary frame part 92 is then moved back to the closed position, the drive roller 56 moves into contact with the roller 58 to form a nip therebetween, through which the film passes. Likewise, the roller 66 moves into contact with the drive roller 54 to form a nip therebetween, through which the film also passes. The result is an S-shaped film drive path 94 as suggested in the top schematic view of FIG. 13. As suggested in the top view of FIG. 13, in order to drive the film in the same direction, driven roller 54 and driven roller 56 must be rotated in opposite directions.

Thus, driven roller 54 is mounted to the primary frame part 90 and driven via gear 76 of the drive arrangement. Driven roller 56 is mounted to the secondary frame part 92 and is driven by a drive gear 84 on the primary frame part 90 that engages with a driven gear 100 at an upper end of the driven roller 56 when the secondary frame part 92 is in the closed position. On the other hand, when the secondary frame part 92 is moved to the open position the driven gear 100 of the driven roller 56 disengages from the drive gear 84 and moves into a spaced apart condition relative to the drive gear 86 as shown in FIG. 9.

It is generally contemplated that in most stretch film wrapping machine implementations, the various rollers of the carriage will all be oriented in upright orientations (i.e., orientations in which the longitudinal axis of the roller is nearer to vertical than it is to horizontal). By way of example, in the machine of the type shown in FIG. 2 the rollers would typically be offset at least fifty degrees from horizontal. In the machine of the type shown FIG. 1, the rollers will typically have a substantially vertical orientation (i.e., wherein the longitudinal axis of the rollers is offset from vertical by no more ten degrees).

As best seen in FIGS. 5 and 9, a housing portion 110 covers the drive arrangement and includes a downwardly extending front portion having a upwardly extending slot 112 formed therein. The slot aligns with the drive gear 84 and the driven gear 100 of the driven roller 56 moves through the slot 112 when the secondary frame part 92 is moved between open and closed positions. In this regard, the secondary frame part 92 may be mounted for pivotal movement about a substantially horizontal 114 axis near the lower end of the carriage 36. A gear cover 116 is located at one side of the driven gear 100 and also moves through the slot 112 when the secondary frame part 92 is moved between open and closed positions. When the secondary frame part 92 is in the closed position, the gear cover 116 and the downwardly extending housing portions alongside the gear cover cooperate to limit access to the driven gear from external of the carriage 36. Alternately, the secondary frame part 92 may be mounted for linear movement toward and away from the primary frame part 90 for transition between the open and closed positions.

Figure 12:
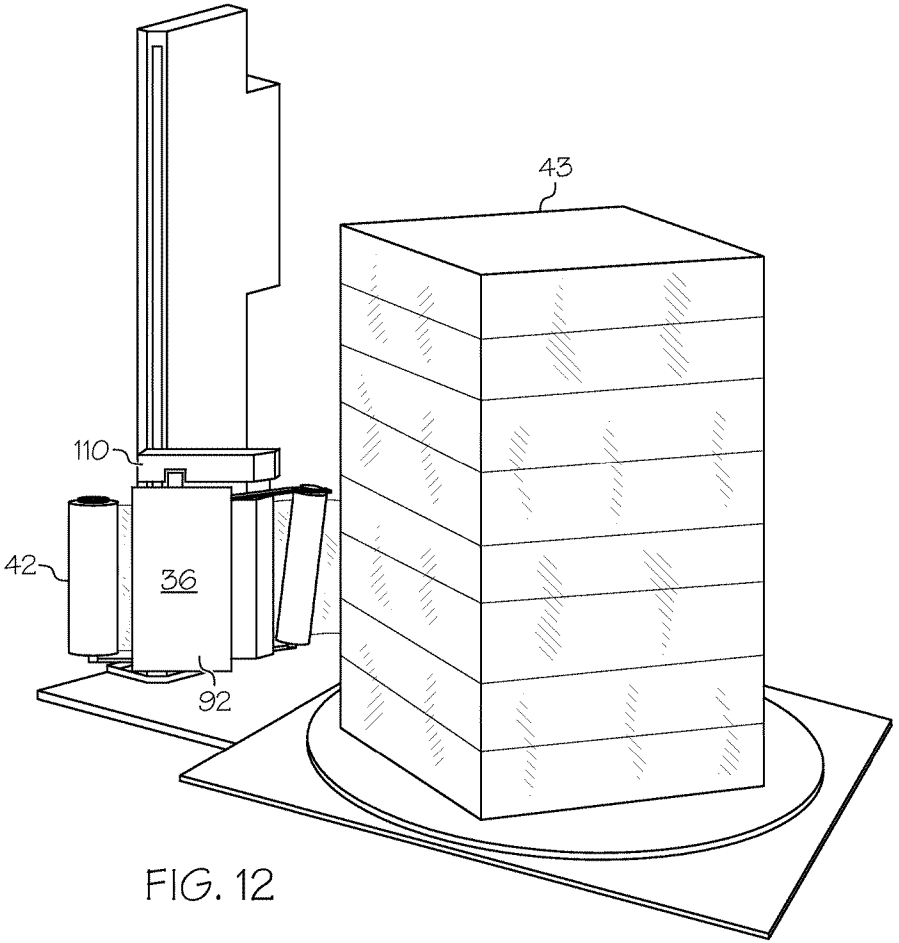
Figure 13:
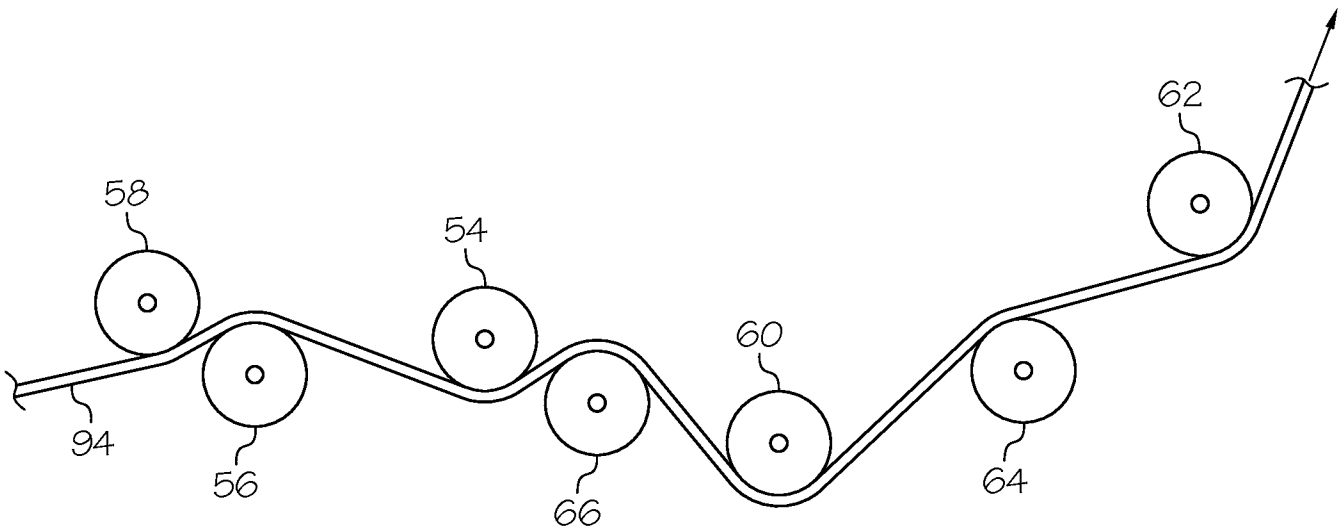
FIG. 13 shows a top schematic view of the film path through rollers on the carriage.

As suggested in FIG. 12, by incorporating the driver roller arrangement atop the carriage, the carriage 36 can be adequately moved downward to a position low enough to dispense film to the bottom of a palletized load.

It is to be clearly understood that the above description is intended by way of illustration and example only and is not intended to be taken by way of limitation, and that changes and modifications are possible.

What is claimed is:

1. A stretch film wrapping machine for wrapping film about palletized loads, comprising:

a wrap location for receiving palletized loads to be wrapped;

a film carriage that is mounted on a mast and movable vertically along the mast and relative to the wrap location during wrap operations, the film carriage including a film path running from a film roll support mandrel and through a roller assembly toward the wrap location, the roller assembly including at least a first driven roller on a first side of the film path and a second driven roller on a second side of the film path opposite the first side, wherein a drive arrangement for the first driven roller and the second driven roller is located at an upper part of the carriage, wherein the carriage includes a primary frame part at the first side of the film path and a secondary frame part at the second side of the film path such that the film path runs between the primary frame part and the secondary frame part and passes between the first driven roller and the second driven roller, the secondary frame part mounted for movement relative to the primary frame part between an open position and a closed position, in the open position at least part of the secondary frame part is moved away from the primary frame part so that the film path is accessible to permit threading film along the film path, in the closed position the secondary frame part is adjacent the primary frame part and the film path is not accessible for threading film, wherein the first driven roller is mounted to the primary frame part, wherein the second driven roller is mounted to the secondary frame part for movement therewith, wherein the drive arrangement includes a drive gear on the primary frame part that engages with a driven gear at an end of the second driven roller when the secondary frame part is in the closed position, and when the secondary frame part is moved to the open position the driven gear of the second driven roller dis-engages from the drive gear and moves into a spaced apart condition relative to the drive gear.

2. The stretch film wrapping machine of claim 1 wherein the drive arrangement is configured to rotate the first driven roller and the second driven roller in opposite directions.

3. The stretch film wrapping machine of claim 1 wherein the first driven roller has an upright orientation, the second driven roller has an upright orientation and the secondary frame part is mounted to pivot away from the primary frame part.

4. The stretch film wrapping machine of claim 3 wherein the first driven roller has a substantially vertical orientation, the second driven roller has a substantially vertical orientation and the secondary frame part is mounted to pivot away from the primary frame part about a substantially horizontal pivot axis located toward a lower end of the carriage, wherein the driven gear is located at an upper end of the second driven roller.

5. The stretch film wrapping machine of claim 1 wherein a housing covers the drive arrangement, the housing includes a downwardly extending housing portion having a upwardly extending slot formed therein, the slot aligned with the drive gear, wherein the driven gear of the second driven roller moves through the slot when the secondary frame part is moved between open and closed positions.

6. The stretch film wrapping machine of claim 5 wherein a gear cover is located at one side of the driven gear, the gear cover also moves through the slot when the secondary frame part is moved between open and closed positions, and when the secondary frame part is in the closed position the gear cover and the downwardly extending housing portions cooperate to limit access to the driven gear from external of the carriage.

7. The stretch film wrapping machine of claim 1 wherein the mast is either (i) movable about the wrap location during wrap operations or (ii) stationary and a load platform of the wrap location is rotated during wrap operations.

8. The stretch film wrapping machine of claim 1, further comprising:

a control arrangement, including a control unit and at least one sensor, for monitoring whether the secondary frame part is in the open or closed position.

9. A film carriage for a stretch film wrapping machine for wrapping film about palletized loads, the film carriage comprising:

a film path running from a film roll support mandrel and through a roller assembly including at least a first driven roller on a first side of the film path and a second driven roller on a second side of the film path opposite the first side and a drive arrangement for the first driven roller and the second driven roller, wherein the carriage includes a primary frame part at the first side of the film path and a secondary frame part at the second side of the film path such that the film path runs between the primary frame part and the secondary frame part and passes between the first driven roller and the second driven roller, the secondary frame part is mounted for movement relative to the primary frame part between an open position and a closed position, in the open position at least a portion of the secondary frame part is moved away from the primary frame part so that the film path is accessible to permit threading film along the film path, in the closed position the portion of the secondary frame part is moved back toward the primary frame part, wherein the first driven roller is mounted to the primary frame part, wherein the second driven roller is mounted to the secondary frame part for movement with the secondary frame part, wherein the drive arrangement includes a drive gear on the primary frame part that engages with a driven gear at an end of the second driven roller when the secondary frame part is in the closed position, and when the secondary frame part is moved to the open position the driven gear of the second driven roller dis-engages from the drive gear and moves into a spaced apart condition relative to the drive gear.

10. The film carriage of claim 9 wherein the drive arrangement for the first driven roller and the second driven roller is located at an upper part of the carriage.

11. The film carriage of claim 9 wherein the first driven roller has an upright orientation, the second driven roller has an upright orientation and the secondary frame part is mounted to pivot away from the primary frame part, wherein the driven gear is located at an upper end of the second driven roller.

12. The stretch film wrapping machine of claim 3 wherein the first driven roller has an upright orientation and the second driven roller has an upright orientation, wherein the secondary frame part is mounted to pivot away from the primary frame part about a substantially horizontal pivot axis located toward a lower end of the carriage, and the driven gear is located at an upper end of the second driven roller.

13. A film carriage for a stretch film wrapping machine for wrapping film about palletized loads, the film carriage comprising:

a film path running from a film roll support mandrel and through a roller assembly including at least a first driven roller on a first side of the film path and a second driven roller on a second side of the film path opposite the first side, wherein the carriage includes a primary frame part at the first side of the film path and a secondary frame part at the second side of the film path such that the film path runs between the primary frame part and the secondary frame part and passes between the first driven roller and the second driven roller, the secondary frame part is mounted for pivotable movement relative to the primary frame part between an open position and a closed position, wherein, in the open position, an upper portion of the secondary frame part is moved away from an upper portion of the primary frame part, wherein, in the closed position, the upper portion of the secondary frame part is moved back toward the upper portion of the primary frame part, wherein the first driven roller is mounted to the primary frame part, wherein the second driven roller is mounted to the secondary frame part for movement with the secondary frame part, wherein the drive arrangement includes a drive gear on the primary frame part that engages with a driven gear at an upper end of the second driven roller when the secondary frame part is in the closed position, and when the secondary frame part is moved to the open position, the driven gear of the second driven roller dis-engages and moves away from the drive gear.

* * * * *